United States Patent [19]

Brenneman et al.

[11] 4,414,832

[45] Nov. 15, 1983

[54] START-UP AND STEADY STATE PROCESS CONTROL FOR COOPERATIVE ROLLING

[75] Inventors: William L. Brenneman, Cheshire; Gary L. Ungarean, Woodbridge; Phillip A. Chatfield, West Haven; Michael J. Pryor, Woodbridge; Joseph Winter, New Haven, all of Conn.

[73] Assignee: Olin Corporation, New Haven, Conn.

[21] Appl. No.: 301,331

[22] Filed: Sep. 11, 1981

[51] Int. Cl.[3] ..... B21B 37/12

[52] U.S. Cl. ..... 72/8; 72/11; 72/16

[58] Field of Search ..... 72/8, 11, 14, 16; 364/469, 472

[56] References Cited

U.S. PATENT DOCUMENTS

| | | | |
|---|---|---|---|
| 2,291,361 | 7/1942 | Walsh | 148/4 |
| 2,316,067 | 4/1943 | Hickman | 72/161 |
| 2,332,796 | 10/1943 | Hume | 72/160 |
| 2,370,895 | 4/1944 | Wean | 72/161 |
| 2,392,323 | 1/1946 | Koss | 72/164 |
| 2,526,296 | 10/1950 | Stone | 72/164 |
| 3,238,756 | 3/1966 | Coffin, Jr. | 72/232 |
| 3,253,445 | 5/1966 | Franek | 72/164 |
| 3,332,292 | 7/1967 | Roberts | 72/8 |
| 3,377,830 | 4/1968 | Campbell | 72/205 |
| 3,394,574 | 7/1968 | Franek et al. | 72/205 |
| 3,527,078 | 8/1968 | Lawson et al. | 72/160 |
| 3,709,017 | 1/1973 | Vydrin et al. | 72/205 |
| 3,798,950 | 3/1974 | Franek et al. | 72/205 |
| 3,811,307 | 5/1974 | Vydrin et al. | 72/205 |
| 3,823,593 | 7/1974 | Vydrin et al. | 72/205 |
| 3,861,188 | 1/1975 | Kamit et al. | 72/234 |
| 3,871,221 | 3/1975 | Vydrin et al. | 72/205 |
| 3,911,713 | 10/1975 | Vydrin et al. | 72/205 |
| 4,145,901 | 3/1979 | Imai et al. | 72/8 |
| 4,145,902 | 3/1979 | Imai et al. | 72/8 |
| 4,173,133 | 11/1979 | Imai et al. | 72/8 |
| 4,244,203 | 1/1981 | Pryor et al. | 72/205 |
| 4,253,322 | 3/1981 | Vydrin et al. | 72/245 |
| 4,257,252 | 3/1981 | Vydrin et al. | 72/232 |
| 4,267,720 | 5/1981 | Vydrin et al. | 72/205 |

FOREIGN PATENT DOCUMENTS

| | | | |
|---|---|---|---|
| 50860 | 8/1970 | Australia . | |
| 46551 | 3/1974 | Australia . | |
| 691139 | 12/1966 | Belgium . | |
| 363259 | 11/1922 | Fed. Rep. of Germany . | |
| 2808888 | 9/1979 | Fed. Rep. of Germany | 72/16 |
| 1506671 | 12/1967 | France . | |
| 1506680 | 12/1967 | France . | |
| 2371246 | 8/1978 | France . | |
| 54-5848 | 1/1979 | Japan . | |
| 54-10258 | 1/1979 | Japan . | |
| 1002936 | 9/1965 | United Kingdom . | |
| 1086643 | 10/1967 | United Kingdom . | |
| 1087097 | 10/1967 | United Kingdom . | |
| 1117585 | 6/1968 | United Kingdom . | |
| 1125554 | 8/1968 | United Kingdom . | |
| 1219967 | 1/1971 | United Kingdom . | |
| 1223188 | 2/1971 | United Kingdom . | |
| 2004486 | 4/1979 | United Kingdom . | |
| 259793 | 4/1970 | U.S.S.R. . | |

OTHER PUBLICATIONS

Coffin, Jr., "Status of Contact-Bend-Stretch Rolling", *Journal of Metals*, Aug. 1967, pp. 14-22.

Vydrin et al., "New Sheet-Rolling Process from Russia", *Machinery and Production Engineering*, vol. 128, No. 3319, Jul. 21 1976, Burgess Hill, Sussex, Great Britain.

Hollmann et al., "Shear Rolling, A New Cold Rolling Method-Rolling Process and Rolling Mill Equipment", *Stahl and Eisen*, vol. 99, No. 6, Mar. 26, 1979, Dusseldorf, Germany.

Hoffman et al., *Introduction to the Theory of Plasticity for Engineers*, McGraw-Hill, 1953, pp. 214-239.

Tobin et al., "Control of Thickness of Metal Sheet and Strip", *Sheet Metal Industries*, Mar. 1960, pp. 203-213.

*Primary Examiner*—Lowell A. Larson

*Attorney, Agent, or Firm*—Barry L. Kelmachter; Howard M. Cohn; Paul Weinstein

[57] ABSTRACT

An apparatus and process for operating a rolling mill having at least two rolls rotating at different speeds to produce a continuous strip material having a substantially constant final thickness comprises a mechanism for controlling the magnitude of the compressive force between the rolls in response to the ratio of the incoming strip speed to the outgoing strip speed. A mechanism is provided for comparing the ratio of the strip speeds to a ratio of the roll speeds and for adjusting the compressive force magnitude until the two speed ratios are substantially equal. In this manner, the amount of off-stage strip material produced during mill start-up is reduced and process stability and gage control during steady state operation is enhanced.

12 Claims, 5 Drawing Figures

START-UP AND STEADY STATE PROCESS CONTROL FOR COOPERATIVE ROLLING

The invention described herein relates to a method and apparatus for producing a continuous strip material having a substantially constant final thickness. The instant invention is applicable to a wide range of metals and alloys which are capable of plastic deformation. The apparatus comprises a mill for rolling strip material under tension to obtain a desired reduction in strip material thickness. The instant invention comprises an apparatus and method for controlling the magnitude of the separating force required to produce the desired reduction in response to the ratio of the speed of the strip material entering the mill to the speed of the strip material exiting the mill.

Many approaches are known in the art which utilize a rolling mill for reducing the thickness of a continuous strip material. The rolling mills used in these approaches have many different configurations including two-high, three-high, and cluster mills. The total reduction which can be achieved in a strip material using these rolling mills before annealing is required is in part determined by the roll separating force generated during the rolling operation. This separating force increases from pass to pass as the metal strip becomes work hardened until a maximum limit is reached for the mill. When the separating force reaches a sufficiently high level, roll flattening, mill elasticity, and strip flow strength are in balance and the mill ceases to make any significant further reductions in the strip material thickness. Normally, prior to the strip material reaching such a separating force level, further rolling is uneconomic and the strip material is annealed to make it softer and thereby reduce the separating force in the next pass through the mill.

It is desirable that the reduction in thickness per pass and the total reduction which can be taken in a strip material by a rolling mill between anneals be as large as possible so as to reduce the need for costly and time-consuming anneals. In many of the prior art approaches, a stretching component has been added to the rolling reduction in order to provide increased percentages of reduction. In order to achieve the desired strip material reductions, various control arrangements for operating these rolling mills have been suggested in the prior art.

One rolling approach comprises contact-bend-stretch rolling, also known as C-B-S rolling. This technique is illustrated in U.S. Pat. No. 3,238,756 to Coffin, Jr., in an article by Coffin, Jr. In *The Journal of Metals, August* 1967, pages 14–22, and in U.K. Patent Specification No. 1,125,554 to Coffin, Jr. In the C-B-S rolling process, plastic bending is provided in conjunction with longitudinal tension and rolling pressure to provide strip or foil thickness reductions. The speed ratio between the contact rolls of the mill is utilized as a means for determining and controlling reduction in place of a conventional rigid roll gap. Longitudinal thickness uniformity is preferably maintained by sensing incoming strip thickness to detect longitudinal thickness variations and then adjusting the speed ratio accordingly. This apparatus is more fully described in the aforenoted article and patents by Coffin, Jr.

Yet another prior art approach comprises a process of rolling metal sheet commonly referred to as "PV" rolling. This process is described in U.S. Pat. Nos. 3,709,017 and 3,823,593 both to Vydrin et al. In this process, a sheet is passed between driven rolls of a rolling mill wherein each adjacent roll is rotated in a direction opposite to that of a next adjacent roll and at a different peripheral speed with respect thereto. The Vydrin et al. patents recognize that the ratio between the peripheral speeds of each adjacent pair of roll is equal to the reduction of the sheet passing therebetween. Therefore, the process is effected with a ratio between the peripheral speeds of the rolls controlling the reduction of the sheet being rolled. The rate of travel of the delivery end of the sheet is equal to the peripheral speed of the driving roll that is rotated at a greater speed. Tension is applied to at least the leading portion of the strip and the application of back tension is also described.

U.S. Pat. Nos. 3,811,307, 3,871,221, 3,911,713, and 4,253,322 all to Vydrin et al., U.K. Patent Application No. 2,004,486A to Vydrin, French Demande De Brevet D'Invention No. 2,371,246 to Vydrin et al., "New Sheet-Rolling Process from Russia", *Machinery and Production Engineering,* Vol. 128, No. 3319, July 21, 1976, Burgess Hill, Sussex, Great Britain, and "Shear Rolling, A New Cold Rolling Method-Rolling Process and Rolling Mill Equipment", Hollmann et al., *Stahl and Eisen, Vol.* 99, No. 6, Mar. 26, 1979, Dusseldorf, Germany discuss various aspects of PV rolling as well as modifications and improvements which have been made to the PV rolling mill and process. Of particular interest is U.S. Pat. No. 4,253,322 to a method of controlling the thickness of strip stock being rolled. In this method, an adjusting force is established for moving the supports of one of the rolls. The magnitude of the adjusting force is greater than the rolling force and is applied to the roll supports to overcome the rolling force, the difference between the adjusting force and the rolling force causes the roll supports to move. Another force is established proportionate to the amount of the movement so as to prevent the supports of the rolls, between which the strip stock is deformed, from moving towards each other and to balance the difference between the adjusting force and the rolling force. The factor of proportionality between the movement of the roll supports and the balancing force is in a definite predetermined ratio with the mill stand stiffness factor. The adjusting force is changed in the course of strip stock deformation to compensate for the roll gap variation.

Many other techniques have been suggested for rolling in a non-conventional manner wherein there is stretching of the strip. Illustrative of such processes and apparatuses are U.S. Pat. Nos. 2,291,361, to Walsh; 2,316,067 to Hickman; 2,332,796 to Hume; 2,370,895 to Wean; 2,392,323 to Koss; 2,526,296 to Stone; 3,253,445 to Franek; 3,332,292 to Roberts; 3,377,830 to Campbell; 3,394,574 to Franek et al.; 3,527,078 to Lawson et al.; 3,798,950 to Franek et al.; and 3,861,188 to Kamit et al.; Australian Patent Document Nos. 46,551 and 50,860; Belgium Patent Document No. 691,139; Fed. Rep. of Germany Patent Document No. 363,259; French Pat. Nos. 1,506,671 and 1,506,680; Japanese Pat. Nos. 54-5848 and 54-10258; U.K. Patent Specification Nos. 1,002,936; 1,086,643; 1,087,097; 1,117,585; 1,219,967 and 1,223,188; Russian Pat. No. 259,793, *Introduction to the Theory of Plasticity for Engineers,* Hoffman et al., McGraw-Hill, 1953, pp. 214–239, and "Control of Thickness of Metal Sheet and Strip", Tobin et al., *Sheet Metal Industries,* March 1960, pp. 203–213.

Various approaches for presetting a rolling mill and for controlling a rolling mill are discussed in the abovementioned documents. U.S. Pat. No. 2,332,796 to Hume discusses several known mechanisms for determining strip reduction in an operating reducing process. These mechanisms include measuring the thickness of the material before and after reduction, measuring the extension of the material from the reduction, and comparing the rate of movement of the reduced material with the rate of movement of the unreduced material. Hume suggests adjusting strip tension to obtain a desired strip reduction by correlating the drives of the pay-off and take-up reels and/or adjusting work roll position.

U.S. Pat. No. 3,332,292 to Roberts discloses a control system for operating a rolling mill to maintain strip gage constant. Roberts' control system comprises entry and exit thickness gages to measure strip thickness before and after reduction. If the exit thickness is not that which is desired, the speed of one of the motors used to drive one of the rolls is adjusted whereby strip tension is adjusted. Thereafter, screw-down devices are actuated to adjust the compression on the strip so that the compression force to tension force ratio returns to a predetermined ratio.

U.K. Patent Specification No. 1,223,188 to Grinsted discloses a control system utilizing at least one strip thickness sensor to produce a strip of substantially constant reduced thickness. The signals from the sensing device are used to control the pressure exerted by a roll, and/or the tensions exerted by the exit and entry bridles and/or additionally to control the torques applied on the driving shafts.

Yet another approach to reducing the thickness of strip material is disclosed in U.S. Pat. No. 4,244,203 to Pryor et al. and in co-pending U.S. patent application Ser. Nos. 167,084, filed July 9, 1980 to Pryor et al., now U.S. Pat. No. 4,329,863 and 260,491, filed May 4, 1981 to Brenneman. This approach passes the strip material through a mill having back-up and work rolls in a serpentine arrangement to provide, for example, three reductions per pass. Forward and back tension are applied to the strip during rolling.

In utilizing the apparatus of this latter approach, it has been discovered that optimum process stability requires that the circumferential velocities of the back-up rolls equals that of the contacting strip material. If the strip velocities are something other than that of the back-up rolls, several problems may be encountered. First, material may accumulate, i.e. a loop may form, on one of the rolls and the strip material may fold over and break. Second, the ability to maintain good gage control may be lost. Third, the separating force required to attain a desired reduction may significantly increase. Fourth, roll life may be reduced as a result of wear associated with the relative motion between the strip and roll surfaces.

In accordance with the instant invention, a method and apparatus is provided for producing a continuous strip material having a substantially constant final thickness. The method and apparatus of the instant invention permit optimum process stability during steady state rolling and a reduction in the amount of off-gage strip produced during mill start-up. The instant invention controls the magnitude of the separating force used to effect strip reduction in response to the ratio of the speed of the strip material entering the mill to the speed of the strip material exiting the mill.

In accordance with the instant invention, a control system is disclosed wherein the thickness of the strip material entering the mill is sensed and the speed ratio of the back-up rolls is adjusted to obtain a desired reduction. The control system of the instant invention also senses the speed of the strip material entering and exiting the mill. A strip speed ratio, which is the ratio of the sensed strip material entry speed to the sensed strip material exit speed, is compared to the speed ratio of the back-up rolls. If the strip speed ratio is different from the roll speed ratio, the separating force is adjusted until the two ratios are substantially equal. In this manner, optimum process stability during steady state rolling may be achieved and the amount of off-gage strip produced at the beginning of a pass may be reduced.

Accordingly, it is an object of the invention to provide an improved process and apparatus for rolling metal or metal alloy strip material.

It is a further object of this invention to provide a process and apparatus as above for achieving optimum process stability and gage control during steady state rolling.

It is a further object of this invention to provide an improved process and apparatus as above for reducing the amount of off-gage strip produced at the beginning of a pass during mill start-up.

It is a further object of this invention to provide an improved process and apparatus as above for producing a continuous strip material having a substantially constant final thickness by controlling the magnitude of the compressive or separating force between at least two rolls of a rolling mill in response to the ratio of the speed of the strip entering and exiting the mill.

These and other objects will become more apparent from the following description and drawings wherein like numerals depict like parts.

Figure 1:
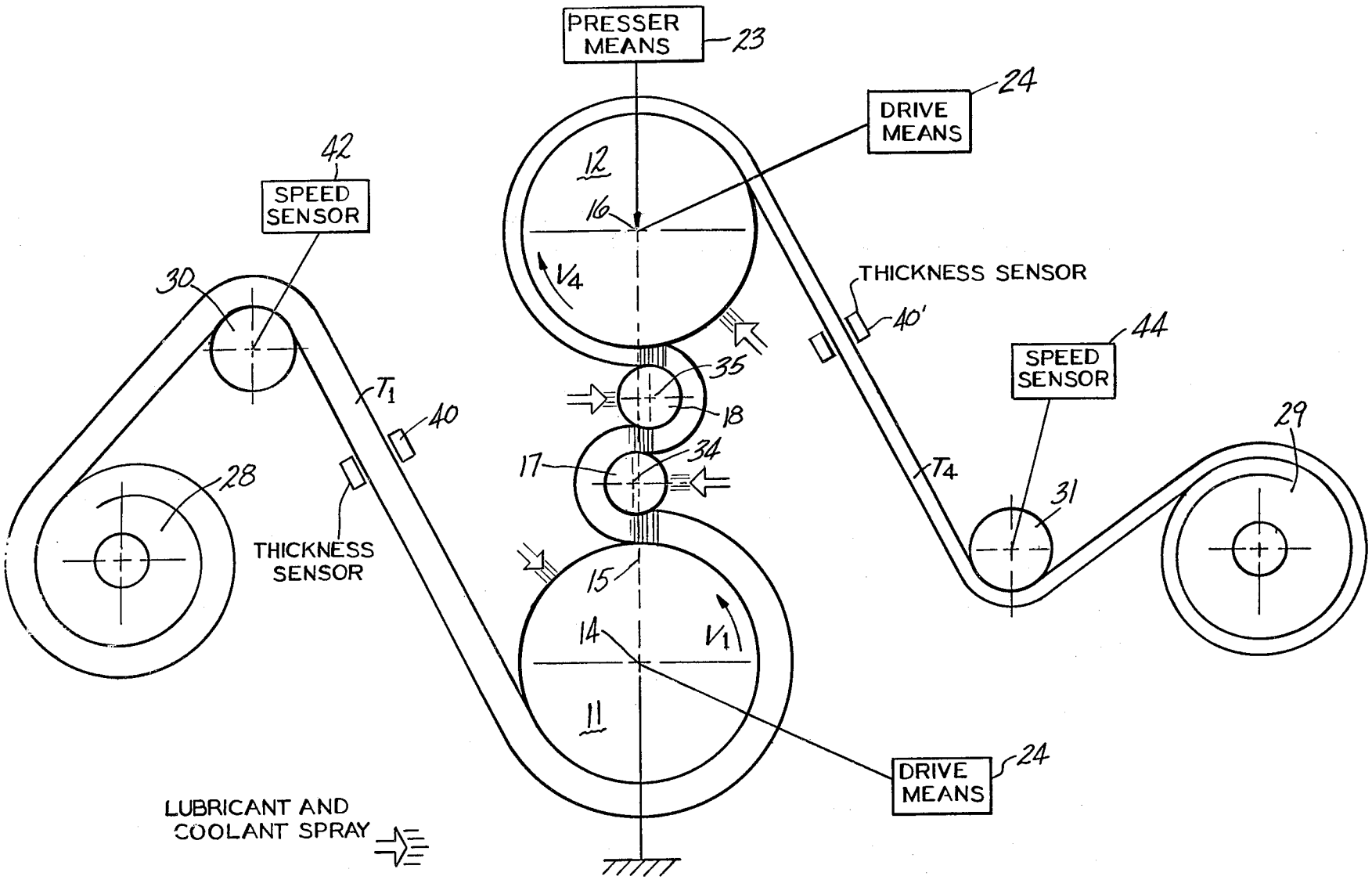
FIG. 1 is a schematic illustration of a side view of an apparatus in accordance with an embodiment of this invention.
Figure 3:
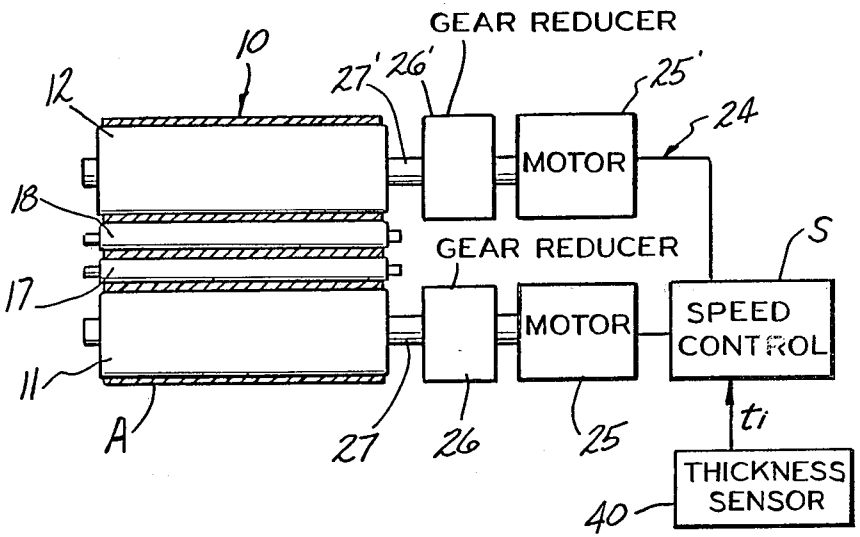
FIG. 3 is a partial view showing the drives to the rolls of the apparatus of FIG. 1.
Figure 2:
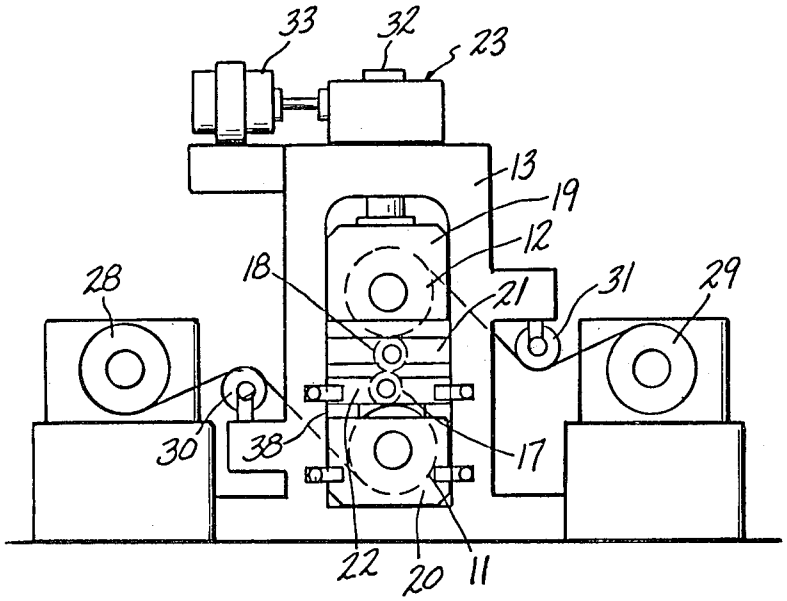
FIG. 2 is a more detailed illustration of the apparatus of FIG. 1.
Figure 4:
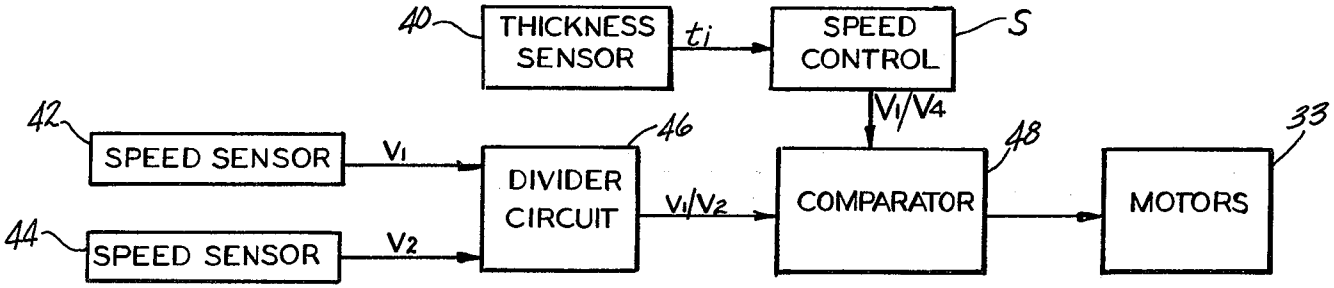
FIG. 4 is a schematic illustration of a control system for operating the apparatus of FIG. 1 in accordance with the instant invention.
Figure 5:
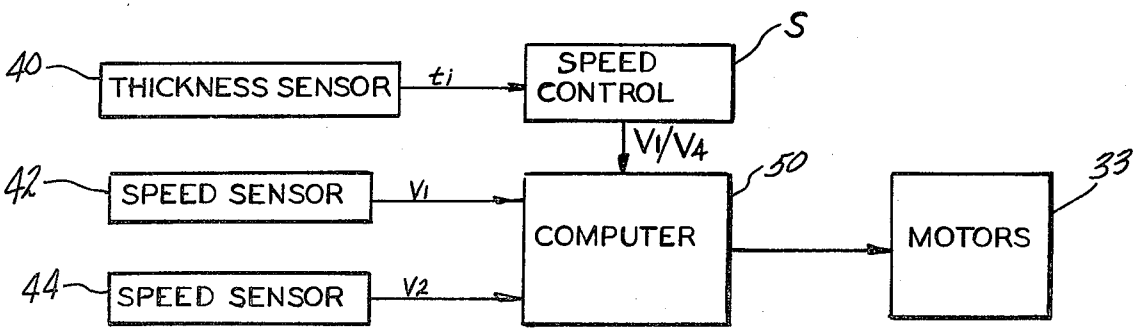
FIG. 5 is a schematic illustration of an alternative control system for operating the apparatus of FIG. 1.

In accordance with this invention, a rolling process and apparatus is provided, preferably of the cooperative type. The rolling system optimizes bi-axial forces to maximize rolling reduction through a process of non-symmetrical plastic flow. It is applicable to any desired metal or alloy which can be plastically deformed. It is particularly adapted for processing metal strip material. Unusually high rolling reductions per pass and total rolling reductions between anneals with excellent surface finish and microstructure can be achieved through the use of a four-high rolling mill modified in accordance with this invention. The approach disclosed herein makes maximum utilization of the deformation ability of the metallic strip material by optimization of roll compression and stretch elongation to derive maximum ductility.

The modification of the rolling mill described herein involves providing a control system which will permit a reduction in the amount of off-gage strip produced at the beginning of a pass during mill start-up and which will optimize process stability and gage control during steady state rolling. The control system of the instant invention should permit maximum process efficiency and control by maintaining the circumferential velocities of the mill back-up rolls substantially equal to that of the contacting strip.

Referring now to FIGS. 1–4, there is shown by way of example a cooperative rolling mill 10 in accordance with a preferred embodiment of the present invention. The cooperative rolling mill 10 comprises first 11 and second 12 back-up rolls of relatively large diameter. The lower back-up roll 11 is journaled for rotation in the machine frame 13 of the rolling mill about a fixed horizontal roll axis 14. The upper back-up roll 12 is journaled for rotation in the machine frame 13 about roll axis 16 and is arranged for relative movement toward and away from the lower back-up roll 11 along the vertical plane 15 defined by the back-up roll axes 14 and 16. Arranged between the upper 12 and lower 11 back-up rolls are two free wheeling work rolls 17 and 18 having a diameter substantially smaller than the diameter of the back-up rolls 11 and 12. The work rolls 17 and 18 are journaled for rotation and arranged to idle in the machine frame 13. They are adapted to float in a vertical direction along the plane 15. The specific support mechanism 19, 20, 21 and 22, etc. for the respective rolls 11, 12, 17 and 18 of the mill 10 may have any desired structure in accordance with conventional practice.

A motor driven screwdown presser means 23 of conventional design is utilized to provide a desired compressive force, known as the separating force, between the back-up rolls 11 and 12 and their cooperating work rolls 17 and 18 and between the work rolls themselves.

The speed relationship between the lower back-up roll 11 and the upper back-up roll 12 is such that the peripheral speed of the lower back-up roll $V_1$ is less than the peripheral speed $V_4$ of the upper back-up roll 12. This can be accomplished relatively easily by a two motor drive 24 as in FIG. 3 which will drive the upper back-up roll 12 at a higher speed relative to the lower back-up roll 11 in proportion to the desired reduction in thickness of the strip A through the mill. The back-up rolls 11 and 12 are driven by motors 25 and 25' which are connected to the rolls 11 and 12 through reduction gear boxes 26 and 26' and drive spindles 27 and 27'. A speed control S is connected to the motors 25 and 25' in order to drive the rolls 11 and 12 at the desired speed ratio. The particular drive system 24 which has been described above does not form part of the present invention, and any desired drive system for driving the rolls 11 and 12 at the desired peripheral speed ratio could be employed. The drive to the work rolls 17 and 18 is provided by the back-up rolls 11 and 12 acting through the encompassing strip A.

The strip A is strung or threaded as shown in FIG. 1 whereby the incoming strip is wrapped around the slower moving back-up roll 11 and then forms an "S" shaped bridle around the work rolls 17 and 18 and finally exits by encompassing the fast moving back-up roll 12. In this manner, three reductions as shown in FIG. 1 are taken in the strip A as it passes through the mill 10. The first reduction is between the slow moving lower back-up roll 11 and its cooperating lower work roll 17. The second reduction is between the lower and upper work rolls 17 and 18. The third reduction is between the upper work roll 18 and its cooperating fast moving upper back-up roll 12. Forward and back tensions $T_4$ and $T_1$ are applied to the strip A in a conventional manner by any desired means such as the coilers/decoilers 28 and 29. Billy or idler rolls 30 and 31 arranged as shown are used to redirect strip A direction to provide the desired wrapping about the back-up rolls 11 and 12. Any suitable idler roll arrangement may be utilized for billy or idler rolls 30 and 31.

The strip A encompasses each of the work rolls 17 and 18 through about 180° of the circumference of the rolls. In the embodiment shown, strip A encompasses each of the back-up rolls 11 and 12 to a greater extent, namely about 270°.

Coolant and lubricant may be selectively applied to the back-up rolls 11 and 12 and work rolls 17 and 18. The specific apparatus for applying the coolant and lubricant may be of any desired conventional design as are known in the art. One system for applying the coolant and lubricant is that disclosed in co-pending U.S. patent application Ser. No. 260,491, filed May 4, 19781 to Brenneman, which is hereby incorporated by reference.

In operation the strip A is threaded through the mill 10 in the manner shown in FIG. 1 and suitable forward and back tensions $T_4$ and $T_1$ are applied to the leading and trailing portions of the strip A by means of the coilers/decoilers 28 and 29. The presser means 23 which may be of any conventional design and which may be hydraulically actuated (not shown) or screw 32 actuated through a suitable motor drive 33 is operated to apply a desired and essential operating pressure or compressive force between the respective rolls 11, 12, 17 and 18. The tensions $T_1$ and $T_4$ applied to the strip A should be sufficient to prevent slippage between the rolls 11, 12, 17 and 18 and the strip A. The motor 25 is energized to advance the strip A through the mill 10 by imparting drive to the back-up rolls 11 and 12 which in turn drive the idling work rolls 17 and 18 through strip A. The upper back-up roll 12 and the work rolls 17 and 18 may be arranged for floating movement vertically along the plane 15. In one embodiment not shown the roll axes 14, 16, 34 and 35 of each of the back-up rolls 11 and 12 and work rolls 17 and 18, respectively, all lie in the single vertical plane 15. In the preferred embodiment, however, to attain greater stability for the work rolls 17 and 18, the plane defined by the axes 34 and 35 of the work rolls 17 and 18 can be tilted very slightly with respect to the plane 15 defined by the axes 14 and 16 of the back-up rolls 11 and 12. Any suitable tilt angle as known in the art may be defined between the plane of the work rolls 17 and 18 and the plane of the back-up rolls 11 and 12. The plane of the work rolls 17 and 18 when tilted should preferably be tilted in a direction to further deflect the strip A, namely clockwise as viewed in FIG. 1. However, it may not be essential in accordance with this invention that the plane of the work rolls 17 and 18 be tilted with respect to the plane 15 of the back-up rolls 11 and 12 and such an expedient is preferably employed when it is necessary to provide stabilization of the work rolls 17 and 18.

It is preferred in accordance with the instant invention that the presser means 23 be adapted to apply the pressure to the respective rolls 11, 12, 17 and 18 rather than generating such pressure between the respective rolls solely by means of the tension applied to the strip. When the mill 10 is powered up and put under reasonable separating force by the presser means 23, the three reduction points are attained as shown in FIG. 1.

In the cooperative rolling process of the present invention utilizing the apparatus 10 described results in three rolling reductions being accomplished in one pass of the strip A through the mill 10. As shown in FIG. 1, it is believed that the forward and back tensions in the reduction zones for this process are partially provided by the wrapping of the strip A around the driven back-up rolls 11 and 12 in such a way as to provide shear drag on the strip. Since the work piece or strip A encompasses the slower large driven roll 11, little or no slipping should occur around the periphery of this roll 11 because of the back tension $T_1$ provided by the coiler/-decoiler 28 and the shear drag of the roll itself. A similar situation exists for the upper back-up roll 12 because of the forward tension $T_4$ and the shear drag of this roll. The driven uppermost large back-up roll 12 should be driven at a peripheral speed consistent with the final desired gage of the strip A. Accordingly, it will be rotating at a peripheral speed $V_4$ relative to the speed $V_1$ of the lower back-up roll 11 which is proportional to the total reduction which is to be done in the roll stand 10.

When the mill 10 is powered up, there is a period of time until the process is stabilized when off-gage strip will be produced. For economic reasons, it is desirable that the amount of off-gage strip produced be minimized. To facilitate mill start-up and reduce the amount of off-gage strip, a thickness sensor 40 for sensing the thickness $t_i$ of the incoming strip A is provided. Thickness sensor 40 may comprise any suitable conventional sensing device as is known in the art. Thickness sensor 40 produces a signal $t_i$ indicative of the incoming strip thickness and transmits the signal either directly to speed control S or to a control panel not shown. When used as a reversing mill, a second thickness sensor 40' is provided as shown for rolling in the direction opposite to that shown. When the signal is directly transmitted to speed control S, the back-up roll speed ratio $V_1/V_4$ is adjusted by speed control S to obtain the desired reduction in strip thickness. The back-up roll speed ratio $V_1/V_4$ being equal to the ratio of the final strip thickness $t_f$ to the incoming strip thickness $t_i$. In a preferred manner, the back-up roll speed ratio is adjusted by adjusting the speed of only one of the back-up rolls, preferably the entry back-up roll. The speed of the other back-up roll is preferably held constant. Alternatively, the back-up roll speed ratio may be adjusted by changing the speed of both of the back-up rolls. If the incoming thickness signal $t_i$ is transmitted to a control panel, the mill operator may then manually operate speed control S to adjust the back-up roll speed ratio to obtain the desired strip thickness reduction.

Mill 10 is also provided with sensors 42 and 44 for sensing the peripheral speed of the billy rolls 30 and 31. By sensing the speed of the billy rolls, the speeds of the strip in $v_1$ and out $v_2$ of the mill can be determined since the circumferential velocities of the billy rolls match the velocities of the contacting stirp A. Signals indicative of the entry $v_1$ and exit $v_2$ speeds of strip A may be transmitted from sensors 42 and 44, respectively, to a conventional divider circuit 46 to form a strip speed ratio $v_1/v_2$. The strip speed ratio $v_1/v_2$ may then be transmitted to a conventional comparator 48 where it is compared to the back-up roll speed ratio $V_1/V_4$. A signal indicative of the back-up roll speed ratio is transmitted from speed control S to comparator 48. Comparator 48 produces a signal indicative of the difference between the strip speed ratio and the back-up roll speed ratio. This signal is preferably transmitted to motors 33 to operator presser means 23 to increase or decrease the magnitude of the separating force until the strip speed ratio is substantially equal to the roll speed ratio. Alternatively, the signal from comparator 48 may be transmitted to an alarm not shown on a mill control panel not shown. The alarm may be any conventional alarm which would be triggered when the strip speed ratio differs from the roll speed ratio. When the alarm is triggered, motors 33 and presser means 23 may be operated manually by the mill operator to increase or decrease the separating force magnitude until the strip speed ratio is substantially equal to the back-up roll speed ratio.

In lieu of divider circuit 46 and comparator 48, signals from sensors 42 and 44 and from speed control S may be transmitted to a computer 50. Computer 50 may comprise any conventionally known computer hardware. Computer 50 preferably receives the various speed signals from sensors 42 and 44 and forms the strip speed ratio $v_1/v_2$. Computer 50 compares the strip speed ratio to the back-up roll speed ratio and, if necessary, generates a signal to operate motors 33 to adjust the separating force so that the strip speed ratio is substantially equal to the roll speed ratio. In lieu of operating motors 33, computer 50 may transmit a signal to an alarm on the mill operator's control panel and the mill operator may operate motors 33 accordingly.

During mill start-up, the forward and back tensions $T_4$ and $T_1$ are set at desired values, the thickness of the incoming strip is measured, and speed control S is set for a back-up roll speed ratio to obtain a desired reduction. The mill starts moving relatively slowly. The separating force is rapidly increased until the sensed strip speed ratio is substantially equal to the back-up roll speed ratio. At this point, the magnitude of the separating force is noted and then increased by up to about 5%. It has been observed that when the back-up rolls 11 and 12 and strip A are moving together, there is a range of values over which the separating force can fluctuate without affecting the gage reduction attained. This range of values is known as the operating window. By increasing the separating force by up to about 5%, the process will operate near the center of the operating window.

Prior art systems frequently use an exit strip thickness gage to detect slippage between the strip and back-up rolls. If an exit strip thickness gage is used during start-up to determine when the appropriate separating force has been reached, the separating force must be increased incrementally and the strip allowed to exit the mill before a decision can be made if more separating force must be applied to attain the desired reduction. The time delay caused by the strip passing from the last roll bite to the exit gage means more off-gage strip will be produced before corrective measures are taken. By using sensors 42 and 44 to detect slippage between the back-up rolls 11 and 12 and the strip, a quicker adjustment to the separating force can be effected and, consequently, the amount of off-gage strip reduced.

During steady state rolling, optimum process stability requires that the circumferential velocities of the back-up rolls 11 and 12 equal that of the contacting strip. Once the mill has been configured to operate for steady state rolling, there are factors which may cause the separating force to move out of the operating window. These factors include significant variations in the gage of the incoming strip and changes in strip flow strength due to end-to-end composition gradient or grain size gradient in the coil, strain rate sensitivity of the material as the mill is accelerated or decelerated, and/or fluctuations in rolling temperature due to the heat of deformation and the rate with which the heat is extracted. As a result of the separating force moving out of the operating window, the strip velocities may become something other than the circumferential velocities of the back-up rolls and several problems may be encountered. These problems could include: material accumulation or looping on one of the work rolls causing strip folding and possibly strip breakage; the loss of the ability to maintain good gage control; significant increases in the separating force required to attain a given reduction; and a reduction in back-up roll life as a result of wear associated with the relative motion between the strip and the back-up roll surfaces.

During steady state rolling, variations in incoming gage would be detected by thickness sensor 40 and the back-up roll speed ratio $V_1/V_4$ adjusted, if necessary, to produce a strip of uniform thickness on the exit side of the mill. The back-up roll speed ratio is preferably adjusted as discussed hereinbefore. An adjustment to the back-up roll speed ratio may necessitate an adjustment to the strip speed ratio to prevent strip slippage. Slippage occurs when the strip speeds differ from the respective back-up roll speeds. Since they receive either a strip speed ratio signal or strip speed signals from sensors 42 and 44, as well as a roll speed ratio signal from speed control S, either comparator 48 or computer 50 will detect slippage. When either comparator 48 or computer 50 detects slippage, a signal is preferably transmitted to motors 33 as discussed hereinbefore to change the magnitude of the separating force and, consequently, the strip speed ratio. The magnitude of the separating force is preferably changed until the strip speed ratio substantially equals the roll speed ratio. If the strip speed ratio is less than the back-up roll speed ratio, then the separating force is too high and should be reduced. If the strip speed ratio is greater than the back-up roll speed ratio, then the separating force is not high enough and needs to be increased. By using sensors 42 and 44 and either comparator 48 or computer 50 to detect slippage in a rather prompt fashion, off-gage strip, strip breakage and the other noted problems should be avoided.

In summary, a system for operating a rolling mill to produce a strip material having a substantially constant final thickness has been disclosed herein. The system in accordance with the instant invention decreases the amount of off-gage strip produced during mill start-up by permitting a quicker setup of the mill operational configuration by using a comparison between the roll speed ratio needed to obtain a desired strip reduction and the strip speed ratio to adjust the separating force magnitude. The system in accordance with the instant invention also enhances process stability and gage control during steady state rolling by measuring incoming strip thickness, adjusting the roll speed ratio if necessary, and more rapidly detecting slippage of the strip material by measuring strip entry and exit speeds, comparing the strip speed ratio to the roll speed ratio, and adjusting the separating force magnitude so that the strip speed ratio and roll speed ratio are maintained substantially equal.

It is believed that the invention described herein is widely applicable to the rolling of stainless steel, copper, copper base alloys, iron and iron alloys, nickel and nickel alloys, aluminum and aluminum alloys as well as any other metal, alloy or other material susceptible of plastic deformation.

While the instant invention has been described with respect to a cooperative rolling apparatus and process, it is applicable to other types of rolling apparatuses and processes.

The word "strip" as used herein is intended to include wires, tubes, rods, and any other continuous material having any suitable cross-sectional shape.

The ratio between the diameters of the back-up rolls 11 and 12 and the diameters of the work rolls 17 and 18 as used herein should preferably range from about 2:1 to 9:1 and most preferably from about 3:1 to 8:1. By using back-up rolls and work rolls having diameters within these ranges, the apparatus as shown in FIG. 1 is adapted to lower the separating forces as compared to a conventional four-high mill.

The amount of wrap of the strip about the driven back-up rolls 11 and 12 depends on the friction and lubricity conditions between the strip A and the respective back-up roll 11 or 12 and may be set as desired to assure minimization of any slippage which might occur between the strip A and the rolls. The total force or pressure between the top and bottom back-up rolls 11 and 12 is positive and less than that required for conventional rolling. Since the gage of the resulting strip A is determined by the relative peripheral speed ratio between the upper and lower back-up rolls 11 and 12, the apparatus 10 is generally operational over a range of pressure.

While a vertical arrangement of the roll stack has been shown, they can be arranged horizontally or otherwise as desired.

The patents, patent applications, and articles set forth in the background of this application are intended to be incorporated by reference herein.

It is apparent that there has been provided in accordance with this invention a start-up and steady state process control for a cooperative rolling mill apparatus which fully satisfies the objects, means, and advantages set forth hereinbefore. While the invention has been described in combination with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

We claim:

1. An apparatus for operating a rolling mill to produce a continuous strip material having a substantially constant final thickness, said apparatus comprising:

said rolling mill having at least two rolls rotating at different speeds, said speeds defining a roll speed ratio;

said strip material entering said mill at a first speed, passing through at least one roll bite formed by said at least two rolls, and exiting said mill at a second speed;

a strip speed ratio being defined by the ratio of said first strip speed to said second strip speed;

means for detecting the thickness of said strip material entering said mill;

means for controlling said roll speed ratio as a function of said detected strip material thickness;

means for producing a compressive force having a magnitude between said at least two rolls; and means for controlling the magnitude of said compressive force in response to said strip speed ratio so that said speed ratios are maintained substantially equal, whereby the amount of off-gage strip material produced during start-up of said mill is reduced and process stability and gage control during steady state operation of said mill is enhanced by maintaining said speed ratios substantially equal.

2. The apparatus of claim 1 wherein said magnitude controlling means also comprises:

means for detecting slippage between said strip material and said at least two rolls.

3. The apparatus of claim 2 further comprising:

said compressive force magnitude controlling means comprising:

means for measuring said first and second strip speeds and producing signals indicative of said strip speeds;

means for receiving said signals and for forming said strip speed ratio;

means for comparing said strip speed ratio to said roll speed ratio and for producing a signal indicative of a difference between said ratios; and means for adjusting said compressive force magnitude in response to said difference signal and thereby adjusting said strip speed ratio until said ratios are substantially equal.

4. The apparatus of claim 3 further comprising: a first idler roll contacting said strip material prior to said entry into said mill;

a second idler roll contacting said strip material after said strip material exit from said mill; and said measuring means comprising means for sensing the rotational speed of each said idler roll and for generating said strip speed signals.

5. The apparatus of claim 3 further comprising:

said thickness detecting means comprising means for producing a signal indicative of said incoming thickness; and said roll speed ratio controlling means comprising means for adjusting the rotational speed of at least one of said rolls in response to said incoming thickness signal so that the desired reduction in said incoming thickness to said final thickness may be obtained.

6. The apparatus of claim 1 further comprising:

said mill having at least first and second driven back-up rolls and at least first and second idling work rolls;

said work rolls being arranged between said first and second back-up rolls and having substantially smaller diameters than said back-up rolls;

means for driving said back-up rolls so that the peripheral speed of said first back-up roll is less than the peripheral speed of said second back-up roll, said roll speed ratio being defined by said peripheral speeds;

said rolls being arranged to take three thickness reductions in said strip material in a single pass through said mill, a first of said reductions being taken in a first roll bite between said first back-up roll and said first work roll, a second of said reductions being taken in a second roll bite between said work rolls and a third of said reductions being taken in a third roll bite between said second work roll and said second back-up roll; and said rolls being arranged so that said strip material travels through said mill in a serpentine fashion wherein said strip material first encompasses said first back-up roll, then forms an S-shaped bridle about said work rolls and then encompasses said second back-up roll.

7. A process for operating a rolling mill having at least two rolls rotating at different speeds which define a roll speed ratio to produce a continuous strip material having a substantially constant final thickness, said process comprising:

passing said strip material into said mill at a first speed, said strip material having an incoming thickness;

detecting said incoming thickness and producing a signal indicative of said incoming thickness;

passing said strip material through at least one roll bite formed by said rolls to effect a reduction in said thickness and causing said strip material to exit said mill at a second speed;

a strip speed ratio being defined by the ratio of said frist speed to said second strip speed;

controlling said roll speed ratio as a function of said detected thickness;

producing a compressive force having a magnitude between said at least two rolls; and controlling the magnitude of said compressive force in response to said strip speed ratio so that said speed ratios are maintained substantially equal, whereby the amount of said strip material produced during start-up of said mill being off-gage is reduced and process stability and gage control during steady state operation of said mill is enhanced by maintaining said speed ratios substantially equal.

8. The process of claim 7 wherein the step of controlling said compressive force magnitude further comprises:

detecting slippage between said strip material and said rolls.

9. The process of claim 8 further comprising:

measuring said first and second strip speeds;

producing signals indicative of said strip speeds;

forming said a strip speed ratio from said strip speed signals;

comparing said strip speed ratio to said roll speed ratio and forming a signal indicative of a difference between said ratios; and said step of controlling said compressive force magnitude comprising adjusting said compressive force magnitude in response to said difference signal and thereby adjusting said strip speed ratio until said ratios are substantially equal.

10. The process of claim 9 further comprising:

providing a first idler roll contacting said strip material prior to passing said strip material into said mill;

providing a second idler roll contacting said strip material after said strip material exits said mill; and said steps of measuring said strip speeds and producing signals indicative of said strip speeds comprising sensing the rotational speeds of said idler rolls and generating signals indicative thereof.

11. The process of claim 9 further comprising:

said step of controlling said roll speed ratio comprising adjusting the rotational speed of at least one of said rolls in response to said incoming thickness signal so that the desired reduction in said incoming thickness to said final thickness may be obtained.

12. The process of claim 7 further comprising:

providing at least first and second driven back-up rolls;

providing at least first and second idling work rolls, said work rolls being arranged between said first and second back-up rolls and having substantially smaller diameters than said back-up rolls;

driving said back-up rolls so that the peripheral speed of said first back-up roll is less than the peripheral speed of said second back-up roll, said roll speed ratio being defined by the ratio of said peripheral speeds;

said step of passing said strip material through at least one roll bite comprising passing said strip material through said rolls in a serpentine fashion wherein said strip material first encompasses said first back-up roll, then forms an S-shaped bridle about said work rolls and then encompasses said second back-up roll, whereby a first reduction in thickness is taken in a first roll bite between said first back-up roll and said first work roll, a second reduction in thickness is taken in a second roll bite between said first and second work rolls and a third reduction in thickness is taken in a third roll bit between said second work roll and said second back-up roll.

* * * * *